United States Patent [19]
Graiff et al.
[11] 4,416,669
[45] Nov. 22, 1983

[54] FUEL AND LUBRICANT COMPOSITIONS FOR OCTANE REQUIREMENT REDUCTION

[75] Inventors: L. B. Graiff, Houston; Z. L. Murphy, Cypress, both of Tex.; J. A. N. Scott, Hillegom ZH, Netherlands

[73] Assignee: Shell Oil Company, Houston, Tex.

[21] Appl. No.: 350,668

[22] Filed: Feb. 22, 1982

[51] Int. Cl.[3] ..... C10L 1/22
[52] U.S. Cl. ..... 44/71; 44/58; 123/1 A; 252/386
[58] Field of Search ..... 44/71, 58; 123/1 A; 252/357, 386; 564/48

[56] References Cited

U.S. PATENT DOCUMENTS

| | | | |
|---|---|---|---|
| 2,195,167 | 3/1940 | Egerton | 564/48 |
| 2,373,372 | 4/1945 | Banks | 44/71 |
| 2,657,984 | 11/1953 | Braithwaite, Jr. et al. | 564/48 |
| 2,762,842 | 9/1956 | Hofliger | 564/48 |
| 3,403,013 | 9/1968 | Eckert | 44/71 |
| 3,615,294 | 10/1971 | Von Allmen | 44/71 |
| 3,762,889 | 10/1973 | Newman et al. | 44/71 |
| 4,105,417 | 8/1978 | Coon | 44/71 |

FOREIGN PATENT DOCUMENTS

| | | | |
|---|---|---|---|
| 1526357 | 9/1978 | United Kingdom | 44/71 |

*Primary Examiner*—Charles F. Warren
*Assistant Examiner*—Margaret B. Medley
*Attorney, Agent, or Firm*—John M. Duncan

[57] ABSTRACT

The reduction of octane requirement in a spark-ignited, internal combustion engine is achieved by introducing, with the combustion intake gasoline charge, a fuel and/or lubricant composition containing an effective octane requirement reduction (ORR) amount of a compound which is both highly polar and soluble in hydrocarbons and yet relatively insoluble in water and which is represented by the formula:

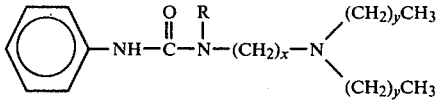

in which X has a value from one to four, Y has a value from zero to three, and R is hydrogen or a hydrocarbyl radical having from one to three carbon atoms.

6 Claims, No Drawings

FUEL AND LUBRICANT COMPOSITIONS FOR OCTANE REQUIREMENT REDUCTION

BACKGROUND OF THE INVENTION

1. Field of the Invention

This invention relates to improved hydrocarbon fuels and engine lubricants which reduce the octane requirements of gasoline-powered automotive engines.

The octane requirement increase (ORI) effect exhibited by internal combustion engines, e.g. spark ignition engines, is well known in the art. This effect may be described as the tendency for an initially new or clean engine to require higher octane quality fuel as operating time accumulates, and is coincidental with the formation of deposits in the region of the combustion chamber of the engine. Thus, during the initial operation of a new or clean engine, a gradual increase in octane requirement (OR), i.e. fuel octane number required for knock-free operation, is observed with an increasing build up of combustion chamber deposits until a rather stable or equilibrium OR level is reached which, in turn, seems to correspond to a point in time where the quantity of deposit accumulation on the combustion chamber and valve surfaces no longer increases but remains relatively constant. This so-called "equilibrium value" is usually reached between about 3,000 and 20,000 miles or corresponding hours of operation. The actual equilibrium value of this increase can vary with engine design and even with individual engines of the same design; however, in almost all cases the increase appears to be significant, with ORI values ranging from about 2 to 10 research octane numbers (RON) being commonly observed in modern engines.

It is also known that additives may prevent or reduce deposit formation, or remove or modify formed deposits, in the combustion chamber and adjacent surfaces and hence decrease OR. Such additives are generally known as octane requirement reduction (ORR) agents.

Development of an additive to control or reduce octane requirements of gasoline-powered automotive engines is particularly attractive now that car manufacturers are increasing compression ratios and optimizing ignition timing to meet increasingly stringent Federal fuel economy standards. Because of these more severe engine conditions, customer knock complaints have increased. Further, current trends indicate that most future model cars will not be satisfied by unleaded gasoline of 91 Research Octane Number, the minimum required by Federal law. Since the demand for unleaded gasoline is increasing rapidly, it is becoming more difficult for oil companies to supply enough high octane unleaded gasoline. For these reasons, customer and car satisfaction could be increased by using gasoline additives that reduce or minimize the octane requirement increase resulting from engine deposits.

Accordingly, it is an object of this invention to provide a class of substituted urea compositions suitable for use as ORR agents when combined with fuel and lubricants designed for use in spark-ignition internal combustion engines.

2. Description of the Prior Art

A number of patents have issued relating to use of urea derivatives to make improvements in gasoline compositions. U.S. Pat. No. 2,373,372 relates the use of alkylated and arylated ureas as antiknock improvers. U.S. Pat. Nos. 3,615,294 and 3,762,889 disclose detergent motor fuel compositions containing substituted ureas as the salt reaction product of a paraffinic oil oxidate and a substituted urea. U.S. Pat. No. 2,195,167 relates to a method of preventing the formation of gum-like products in lubricating oils by adding alkyl or aryl derivatives of urea to oil. U.S. Pat. No. 2,657,984 discloses that the pour point of fuel oils can be improved by adding substituted ureas to the fuel oil.

SUMMARY OF THE INVENTION

According to the invention, there are provided motor fuel and lubricating oil compositions containing an octane requirement reduction amount of a compound represented by the formula:

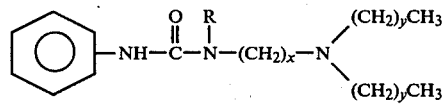

in which X has a value from one to four, Y has a value from zero to three, and R is hydrogen or a hydrocarbyl radical having from one to three carbon atoms. The invention further provides a method for operating a spark-ignition engine which comprises introducing, with the combustion intake charge, an octane requirement reduction amount of a compound represented by the above formula.

DESCRIPTION OF THE PREFERRED EMBODIMENTS

The applicants have now discovered a novel class of compounds which are effective ORR agents. These compounds have the general formula:

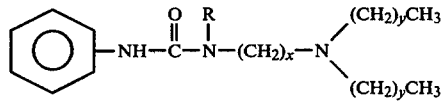

in which X has a value from one to four, Y has a value from zero to three, and R is hydrogen or a hydrocarbyl radical having from one to three carbon atoms.

The compounds have the advantage of being both highly polar and soluble in hydrocarbons, and yet are relatively insoluble in water. Thus they will be leached from the fuel and lubricants by water encountered in fuel storage tanks or in an engine crankcase.

The ORR agents of the present invention can be introduced into the combustion zone of the engine in various ways to prevent build up of deposits or to accomplish reduction or modification of deposits. Thus the ORR agents can be injected directly into the intake manifold intermittently or substantially continuously as desired. A preferred method is to add the agent to the fuel. For example, the agent can be added separately to the fuel or blended with other fuel additives.

Another preferred method of introducing the ORR agents of the present invention into the combustion zone is to add the agent to the crankcase lubricating oil which is eventually conducted to the walls of the combustion chamber, e.g. via the lubricating oil film from the ring swept area of the cylinder.

The fuel to which the additive is added is preferably a gasoline including both unleaded or leaded varieties. As is well known gasoline can be generally defined as a mixture of hydrocarbons of various boiling points, having a boiling range determined according to ASTM method D-86 of between about 20° and 230° C. A suitable gasoline typically contains from about 0 to about 30% volume olefins, from about 5 to about 55%, and preferably from about 10 to about 45%, by volume aromatics, with the remainder being saturated hydrocarbons. As indicated above, useful gasoline based fuels according to the invention may also contain minor amounts of organolead antiknock agents, i.e. tetraaklyllead, as well as other organometallic additives such as manganese derivatives, e.g. methyl cylopentadienyl manganese tricarbonyl which are useful for the same purpose. In such cases, minor amounts of halogen scavenger such as ethylene dibromide and dichloride may also be present. Both the leaded and unleaded gasoline compositions of the invention may contain other conventional additives such as dyes, spark plug anti-foulants, oxidation inhibitors, detergent-dispersants, anti-icing additives, metal deactivators, etc.

The lubricating oils to which the agent of the present invention are added include any conventional synthetic or mineral oil-based lubricating oil. Preferably, the lubricating oil is mineral oil. Suitable mineral oil compositions include any normal or commercial fully formulated motor oil such as those comprised of a paraffin base, naphthene base, mixed paraffin-naphthene base distillate and residual oils. Lubricating oils having an SUS viscosity at 100° F. between about 50 and 1000 may be used. These lubricating oils will typically contain a variety of conventional additives such as detergents, viscosity index improvers, anti-oxidants, etc.

The fuel and lubricating oil composition according to the present invention usually comprise a minor amount of the ORR compound. Suitable octane requirement increase inhibiting amounts are from 10 to 3,00 ppm weight with amounts of from 50 to 1000 ppm weight being preferred.

The invention will now be illustrated with reference to the following Examples, which are intended to be a complete specific embodiment of the invention and are not intended to be regarded as a limitation thereof.

EXAMPLE 1

Additive A is the reaction product of phenylisocyanate (I) and N,N-diethylethylenediamine (II). To 29.8 grams (approximately 0.25 moles) of I in 100 ml of dichloromethane, 29.05 grams (approximately 0.25 moles) of II in 150 ml of dichloromethane was added carefully under reflux. When the exothermic reaction had ceased, the solvent was removed by distillation. The residual product was subjected to vacuum distillation (160°-170° C. at 0.1 mm Hg pressure) to remove unreacted starting material. The yeild of product was approximately 50 grams.

EXAMPLE 2

Additive B is the reaction product of phenylisocyanate (I) and N,N,N'-triethylethylenediamine) (III). To 20.7 grams (approximately 0.17 moles) of I in 100 ml of dichloromethane, 25 grams (approximately 0.17 moles) of III was added carefully under reflux. When the exothermic reaction ceased, the solvent was removed by distillation. The residual product was subjected to vacuum distillation (160°-170° C. at 0.1 mm Hg pressure) to remove unreacted starting material. The yield of product was approximately 40 grams.

EXAMPLE 3

Additive C is the reaction product of N,N-dimethyl-1,3-diaminopropane (IV) and phenyl carbamide (V). To 82 grams (0.80 moles) of IV, a solution of 70 grams (0.51 moles) of V in xylene (200 ml) was added. The mixture was refluxed at 120°-130° C. for 12 hours. Finally, excess IV was removed by distillation (1 hours at 110° C. at 0.01 mm Hg pressure). The yield of product was 114 grams (94%).

EXAMPLE 4

The ORR agents prepared in Example 1-3 were tested in two 1977 Pontiac 301 cubic-inch-displacement engines, both with two-barrel carburetors and automatic transmissions. These V-8 engines were mounted on dynamometer stands equipped with flywheels to simulate the inertia of a car. The tests were run using 93-95 RON unleaded base gasolines and a 10W/50 multigrade motor oil.

A cycle consisting of an idle mode and 35 and 65 mph (57 and 105 Km/hr) cruise modes with attendant accelerations and decelerations was used to accumulate deposits in the engines. Octane requirements of the engines were determined while operating the engines at 2500 rpm wide-open-throttle with the transmission in second gear. Full-boiling-range unleaded reference fuels of one RON increments were employed for the ratings. In the rating procedure, the octane requirement was that of the reference fuel which gave a trace level of knock as determined by the rater. If one reference fuel, say 95 RON, gave no knock, but the reference fuel of one octane number lower (94 RON) gave higher than a trace level of known, the OR was recorded as the average value, 94.5 RON. The determined OR values were corrected for barometric pressure changes, using 2.0 RON per inch of mercury increase in pressure; however, such corrections were usually small (less than 0.5 RON). A Selective Ignition Retard Device (described in SAE Technical Paper No. 801353 which is incorporated herein by reference)[a] was used to determine the octane requirements of the individual cylinders of the engines; that is, nine sets of OR data were obtained from each engine/additive test. During the octane requirement tests (and during most of the cyclic operation of the engine), the temperatures were maintained as follows: jacket water out, 95° C. (203° F.); oil galley, 95° C. (203° F.), and carburetor air, 45° C. (113° F.), with a constant humidity.

[a] L. B. Graiff, M. W. Ehrhardt, E. J. Haury, "A Device and Technique for Determining Octant Requirements of Individual Cylinders of an Engine", Presented at Society of Automotive Engineers Fuels & Lubricants Session, Baltimore, Md., Oct. 20-23, 1980.

Additive tests began after the engines had accumulated at least 500 test hours (about 18,000 equivalent miles) on base fuel. After the octane requirements of the individual cylinders stabilized on the base fuel, the engine was run on about 40 gallons of the same fuel containing 300 ppmw of the additive. The octane requirements were again determined after the additive fuel was run. Test results are shown in Table 1.

TABLE 1

| | OCTANE REQUIREMENT REDUCTIONS[a] ENGINE CYLINDER NUMBER | | | | | | | | | |
|---|---|---|---|---|---|---|---|---|---|---|
| Additive | 1 | 2 | 3 | 4 | 5 | 6 | 7 | 8 | Cyl. Avg. | Engine |
| A | 0.4 | 0.9 | 1.4 | 1.4 | 0.4 | −0.1 | −0.1 | 0.4 | 0.6 | 0.4 |
| B | 0.7 | −1.8 | 0.7 | 0.2 | 1.7 | −0.8 | 0.7 | 0.7 | 0.3 | 0.7 |

TABLE 1-continued

| Additive | OCTANE REQUIREMENT REDUCTIONS[a] ENGINE CYLINDER NUMBER 1 | 2 | 3 | 4 | 5 | 6 | 7 | 8 | Cyl. Avg. | Engine |
|---|---|---|---|---|---|---|---|---|---|---|
| C | 1.4 | 0.9 | −1.1 | 0.4 | 1.9 | 0.4 | −0.1 | 1.4 | 0.6 | 0.4 |

[a]Octane requirement changes less than 0.5 octane number are considered to be not significant because of the rating technique employed.

Table 1 shows that additive A reduced the octane requirements of three cylinders by 0.9 to 1.4 number and had a negligible effect on five cylinders. The overall cylinder average shows an octane requirement reduction of 0.6 number and an engine reduction of 0.4 number. Additive B reduced the octane requirements of five cylinders by 0.7 to 1.7 numbers, had a negligible effect on one cylinder and increased the requirements of two cylinders by 0.8 and 1.8 numbers. The overall cylinder average shows an octane requirement reduction of 0.3 number and an engine reduction of 0.7 number. Additive C reduced the octane requirements of four cylinders by 0.9 to 1.9 numbers, had a negligible effect on three cylinders and increased the requirement of one cylinder by 1.1 numbers. The overall cylinder average shows an octane requirement reduction of 0.6 number and an engine reduction of 0.4 number.

The additive structures are shown in Table 2.

TABLE 2

| Additive | Structure |
|---|---|
| A | 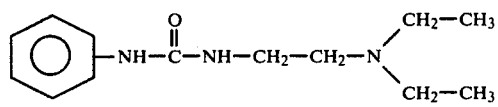 |
| B | 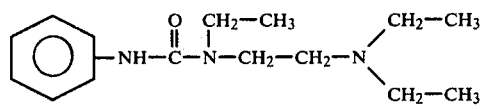 |
| C | 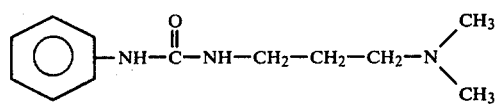 |

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. A gasoline boiling range hydrocarbon fuel composition incorporating a minor amount of an additive composition which is both highly polar and soluble in hydrocarbons and yet relatively insoluble in water and which exhibits octane requirement reduction properties, said additive composition comprising a class of substituted ureas represented by the formula:

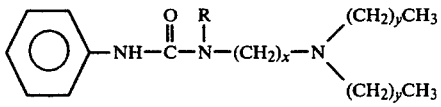

in which X has a value from one to four, Y has a value from zero to three, and R is hydrogen or a hydrocarbyl radical having from one to three carbon atoms.

2. The fuel compositions of claim 1 wherein the additive composition is selected from the group consisting of:

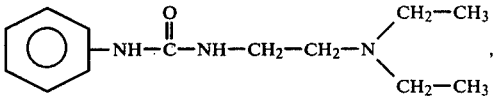

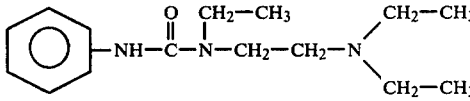

, or

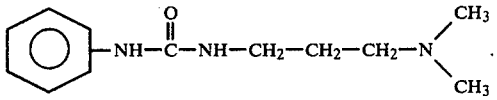

3. The composition according to claim 2 wherein said additive is present in the fuel composition in the amount of from about 10 to about 3000 ppm weight.

4. The composition as in claim 3 wherein the additive is present in an amount of from about 50 to about 1000 ppm weight.

5. A method of operating a spark ignition internal combustion engine which comprises burning in said engine a motor fuel comprising a gasoline boiling range hydrocarbon mixture containing a minor amount of an additive composition comprising an effective amount of a substituted urea which are both highly polar and soluble in hydrocarbons and yet relatively insoluble in water and having octane requirement reduction properties, said urea represented by the formula:

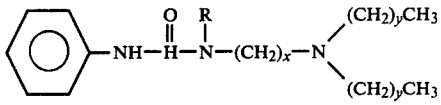

in which X has a value from one to four, Y has a value from zero to three, and R is hydrogen or a hydrocarbyl radical having from one to three carbon atoms.

6. The method of claim 5 wherein the additive composition is selected from the group consisting of:

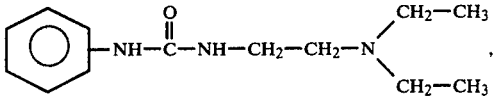

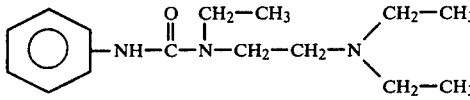

, or

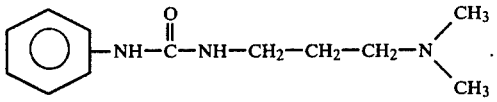

* * * * *